US005931306A

United States Patent [19]

Mitsumura et al.

[11] Patent Number: 5,931,306

[45] Date of Patent: Aug. 3, 1999

[54] GAS CURRENT CLASSIFIER AND PROCESS FOR PRODUCING TONER

[75] Inventors: Satoshi Mitsumura; Hitoshi Kanda, both of Yokohama; Masayoshi Kato, Iruma; Yoko Goka, Kawasaki; Yoshinori Tsuji, Yokohama, all of Japan

[73] Assignee: Canon Kabushiki Kaisha, Tokyo, Japan

[21] Appl. No.: 08/967,169

[22] Filed: Nov. 10, 1997

Related U.S. Application Data

[62] Division of application No. 08/377,111, Jan. 23, 1995, Pat. No. 5,712,075.

[30] Foreign Application Priority Data

Jan. 25, 1994 [JP] Japan ..... 6-023102
Sep. 21, 1994 [JP] Japan ..... 6-251576

[51] Int. Cl.[6] ..... B07B 7/04; G03G 5/00

[52] U.S. Cl. ..... 209/143; 209/2; 209/146; 209/154; 430/137

[58] Field of Search ..... 209/2, 133, 136, 209/137, 139.1, 142, 143, 146, 154; 430/137

[56] References Cited

U.S. PATENT DOCUMENTS 4,639,311 1/1987 Prodi ..... 209/143
4,657,667 4/1987 Etkin ..... 209/154 X
4,802,977 2/1989 Kanda et al. ..... 209/146 X

FOREIGN PATENT DOCUMENTS 4-271876 9/1992 Japan .
5-253547 10/1993 Japan ..... 209/143

*Primary Examiner*—Tuan N. Nguyen
*Attorney, Agent, or Firm*—Fitzpatrick, Cella, Harper & Scinto

[57] ABSTRACT

A gas current classifier has a material feed nozzle, a Coanda block, a classifying wedge and a classifying wedge block having the classifying wedge. The Coanda block and the classifying wedge define a classification zone, and the classifying wedge block is set up in the manner that its location is changeable so that the form of the classification zone can be changed.

6 Claims, 9 Drawing Sheets

GAS CURRENT CLASSIFIER AND PROCESS FOR PRODUCING TONER

This application is a division of application Ser. No. 08/377,111 filed Jan. 23, 1997 now U.S. Pat. No. 5,712,075.

BACKGROUND OF THE INVENTION

1. Field of the Invention

This invention relates to a gas current classifier for classifying a powder by utilizing the Coanda effect. More particularly, the present invention relates to a gas current classifier for classifying a powder into particles with given particle sizes while carrying the powder on air streams and also utilizing the Coanda effect and the differences in inertia force and centrifugal force according to the particle size of each particle of the powder so that a powder containing 50% by number or more of particles with a particle size of 20 $\mu$m or smaller can be classified in a good efficiency.

This invention also relates to a process for producing a toner by means of a gas current classifier for classifying a colored resin powder by utilizing the Coanda effect. More particularly, the present invention relates a process for producing a toner for developing electrostatic images, by classifying the powder into colored resin particles with given particle sizes while carrying the colored resin powder on air streams and also utilizing the Coanda effect and the differences in inertia force and centrifugal force according to the particle size of each particle of the powder so that a colored resin powder containing 50% by number or more of particles with a particle size of 20 $\mu$m or smaller can be classified in a good efficiency.

2. Related Background Art

For classifying powders, various gas current classifiers are proposed. Among them, there are classifiers making use of rotating blades and classifiers having no moving part. Of these, the classifiers having no moving part include fixed-wall centrifugal classifiers and inertial classifiers. As classifiers utilizing inertia force, Elbow Jet classifiers disclosed, e.g., in Loffier, F. and K. Maly, Symposium on Powder Technology D2 (1981) and commercially available as products by Nittetsu Kogyo, and classifiers disclosed, e.g., in Okuda, S. and Yasukuni, J., Proceedings of International Symposium on Powder Technology '81, 771 (1981) have been proposed as inertial classifiers that can carry out classification within fine-powder range.

In such gas current classifiers, as shown in FIGS. 7 and 8, a powder is jetted into a classifying chamber together with an air stream at a high velocity from a material feed nozzle 16 having an orifice in the classification zone of a classifying chamber 32. In the classifying chamber, a Coanda block 26 is provided and air streams crossing the air stream jetted from the material feed nozzle 16 are introduced, where the powder is separated into a group of coarse powder, a group of median powder and a group of fine powder by the action of centrifugal force produced by the curved air streams flowing along the Coanda block 26 and then classified into the group of coarse powder, the group of median powder and the group of fine powder through means of a classifying wedge 117 and another classifying wedge 118 each having a narrow end that forms a tip.

In such a conventional classifier 101, however, classifying wedge blocks 124 and 125 stand stationary, and the positions of the tips of the classifying wedges 117 and 118, respectively, are adjusted so that the flow rates of the air streams for classification can be correspondingly adjusted, to thereby set the classification points (i.e., the particles sizes at which the powder is classified) to the desired values. Also, the tip positions of the classifying wedges, corresponding to the gravity and given classification points of the powder, are detected and moved to provide control so as to maintain the given flow rates. Such control of only the tip positions of the classifying wedges 117 and 118 tends to cause disturbance of air streams in the vicinity of the tips of wedges, depending on their angles, so that, in some instances, no classification can be carried out with good resulting in unauthorized inclusion of particles of a size which should belong to other group of particles, into the group of particles which originally must have a uniform size. Even when it is desired to change the classification points, the locations of the classifying wedges can not be controlled along the direction of air streams if the tip positions of the classifying wedges are shifted to provide control so as to restore the given flow rates. Not only does it takes time to adjust the classification points to the given values, but also the classification precision becomes low, raising problems to be resolved. In particular, when classification is carried out to produce toners for developing electrostatic images, used in copying machines, printers and so forth, such problems tend to dramatically recur.

In general, toners are required to have various properties. The properties of toners are influenced by starting materials used in toners, and may also be often influenced by processes for producing toners. In the step of classification for producing toners, groups of toner particles which have been classified are required to have sharp particle size distributions, and also it is desired to stably produce good-quality toners at a low cost and with a good efficiency.

As binder resins used in toners, it is common to use resins having a low melting point, a low softening point and a low glass transition point. When a colored resin powder containing such resin is introduced into a classifier to carry out classification, the particles tend to adhere or melt-adhere to the inside of the classifier.

In recent years, as measures for energy saving in copying machines, it has become popular to use soft materials such as wax as binder resins, to make fixing speed higher even in the case of heat fixing, and to use binder resins with a low glass transition point or binder resins with a low softening point so that power consumption necessary for fixing can be decreased and fixing can be carried out at a low temperature.

In addition, in order to improve image quality in copying machines and printers, toner particles have exhibited a gradual tendency to be made finer. In general, as substances become finer, the force acting between particles become larger, and the same applies also to resin particles and toner particles, where the particles more greatly tend to agglomerate as their particle size becomes smaller.

Once an external force such as impact force or frictional force acts on agglomerates of such particles, the particles tend to melt-adhere to the inside of the classifier. In particular, the particles tend to melt-adhere to the tips of classifying wedges. Once such a phenomenon has occurred, the classification precision becomes poor and the classifier is not always operable in a stable state, so that it becomes difficult to stably obtain good-quality classified powders over a long period of time.

From such points of view, it is sought to provide a gas current classifier that can stably and efficiently classify, in particular, colored fine resin powders such as toners in a good precision.

SUMMARY OF THE INVENTION

An object of the present invention is to provide a gas current classifier that has solved the problems discussed above.

Another object of the present invention is to provide a gas current classifier that enables classification in a high precision because of accurate setting of classification points, and can produce powders having precise particle size distributions, in a good efficiency.

Still another object of the present invention is to provide a gas current classifier that may hardly cause melt-adhesion of particles in the classification zone, may cause no variations of classification points in the classifier, and can carry out stable classification.

A further object of the present invention is to provide a gas current classifier that enables changes of classification points in wide ranges.

A still further object of the present invention is to provide a gas current classifier that enables changes of classification points in a short time.

A still further object of the present invention is to provide a process for producing a toner for developing electrostatic images, that has solved the problems discussed above.

A still further object of the present invention is to provide a process for producing a toner, that enables classification in a high precision because of accurate setting of classification points, and can produce powders having precise particle size distributions, in a good efficiency.

A still further object of the present invention is to provide a process for producing a toner, that may hardly cause melt-adhesion of particles, may cause no variations of classification points in the classifier, and can carry out stable classification.

A still further object of the present invention is to provide a process for producing a toner, that enables changes of classification points in wide ranges.

A still further object of the present invention is to provide a process for producing a toner, that enables changes of classification points in a short time.

The present invention provides a gas current classifier comprising a material feed nozzle, a Coanda block, a classifying wedge and a classifying wedge block having the classifying wedge, wherein;

the Coanda block and the classifying wedge define a classification zone, and the classifying wedge block is set up in the manner that its location is changeable so that the form of the classification zone can be changed.

The present invention also provides a process for producing a toner, comprising the steps of;

feeding to a material feed nozzle a colored resin powder having a true density of from 0.3 to 1.4 g/cm$^3$;

transporting the colored resin powder on an air stream passing inside the material feed nozzle;

introducing the colored resin powder into a classifying chamber defined between a Coanda block and classifier side walls;

classifying the colored resin powder by utilizing the Coanda effect, to separate it into at least a coarse powder group, a median powder group and a fine powder group by means of a plurality of classifying wedges; and producing the toner from the median powder group thus separated;

wherein;

the classifying wedges are each provided on a classifying wedge block set up in the manner that its location is changeable, and at a location satisfying the following condition:

$$L_0>0,\ L_1>,\ L_2>0,\ L_3>0;\ L_0<L_1+L_2<nL_3$$

where $L_0$ represents a height-direction diameter (mm) of the discharge orifice of the material feed nozzle; $L_1$ represents a distance (mm) between the sides facing each other, of a first classifying wedge for dividing the powder into the median powder group and the fine powder group and the Coanda block provided opposingly thereto; $L_2$ represents a distance (mm) between the sides facing each other, of the first classifying wedge and a second classifying wedge for dividing the powder into the coarse powder group and the median powder group; $L_3$ represents a distance (mm) between the sides facing each other, of the second classifying wedge and a side wall standing opposingly thereto; and n represents a real number of 1 or more.

The present invention still also provides a process for producing a toner, comprising the steps of;

feeding to a material feed nozzle a colored resin powder having a true density of more than 1.4 g/cm$^3$;

transporting the colored resin powder on an air stream passing inside the material feed nozzle;

introducing the colored resin powder into a classifying chamber defined between a Coanda block and classifier side walls;

classifying the colored resin powder by utilizing the Coanda effect, to separate it into at least a coarse powder group, a median powder group and a fine powder group by means of a plurality of classifying wedges; and producing the toner from the median powder group thus separated;

wherein;

the classifying wedges are each provided on a classifying wedge block set up in the manner that its location is changeable, and at a location satisfying the following condition:

$$L_0>0,\ L_1>0,\ L_2>0,\ L_3>0;\ L_0<L_3<L_1+L_2$$

where $L_0$ represents a height-direction diameter (mm) of the discharge orifice of the material feed nozzle; $L_1$ represents a distance (mm) between the sides facing each other, of a first classifying wedge for dividing the powder into the median powder group and the fine powder group and the Coanda block provided opposingly thereto; $L_2$ represents a distance (mm) between the sides facing each other, of the first classifying wedge and a second classifying wedge for dividing the powder into the coarse powder group and the median powder group; and $L_3$ represents a distance (mm) between the sides facing each other, of the second classifying wedge and a side wall standing opposingly thereto.

DESCRIPTION OF THE PREFERRED EMBODIMENTS

In the gas current classifier of the present invention, the form of the classification zone can be changed by changing the location (set-up location) where a classifying wedge block having a classifying wedge is set up, and accordingly the classification point can be readily changed in a wide range. As the set-up location of the classifying wedge block is changed, the location where the classifying wedge is set up is also changed. At the same time, the tip of the classifying wedge is made swing-movable so that the tip position of the classifying wedge can be adjusted. Hence, the classification point can be changed in a wide range and at the same time the classification point can be adjusted in a good precision without causing the disturbance of air streams in the vicinity of the tip of the classifying wedge.

The present invention will be described below in greater detail with reference to the accompanying drawings.

Figure 1:
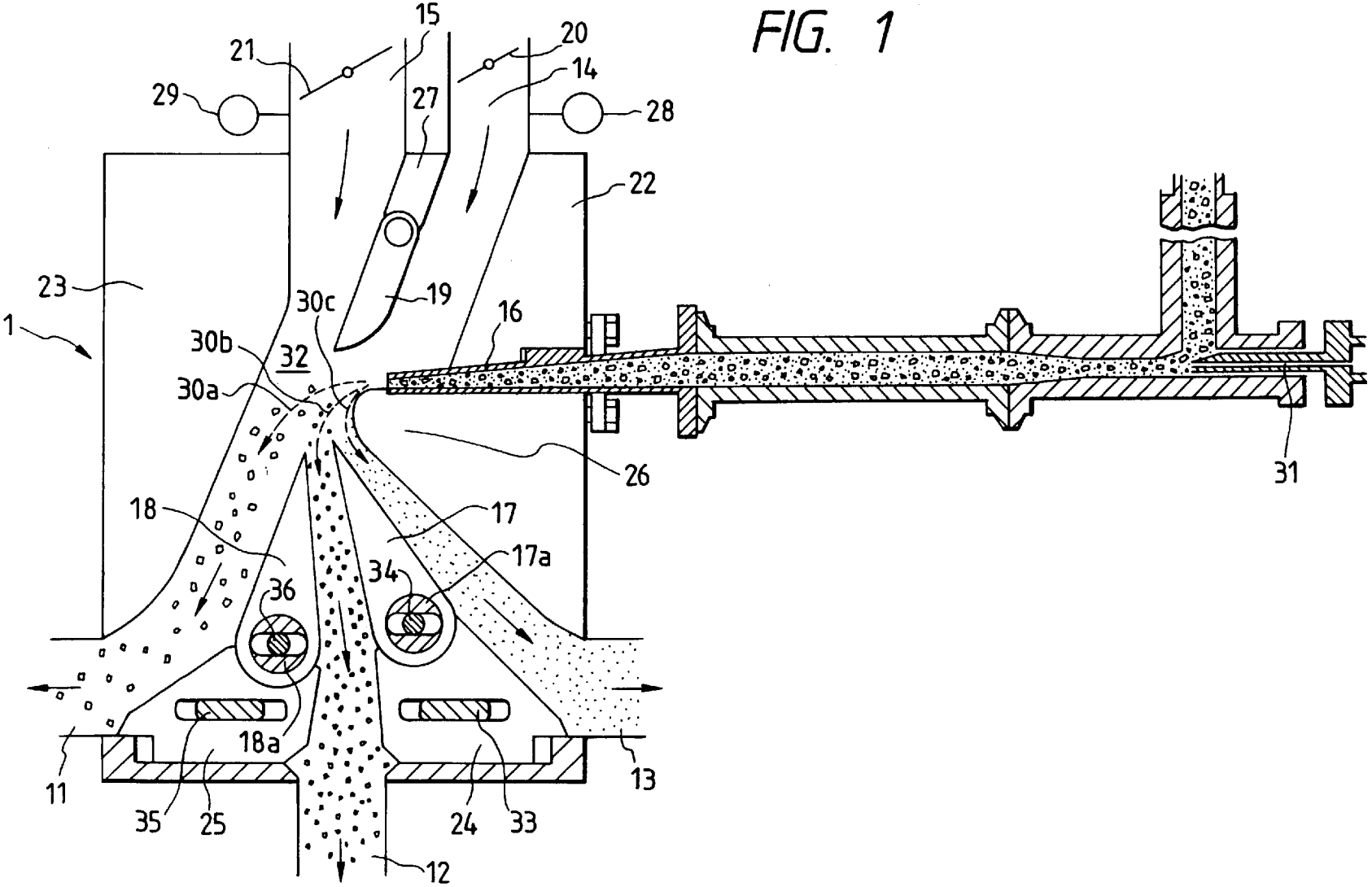
FIG. 1 is a schematic cross section of the gas current classifier of the present invention.
Figure 2:
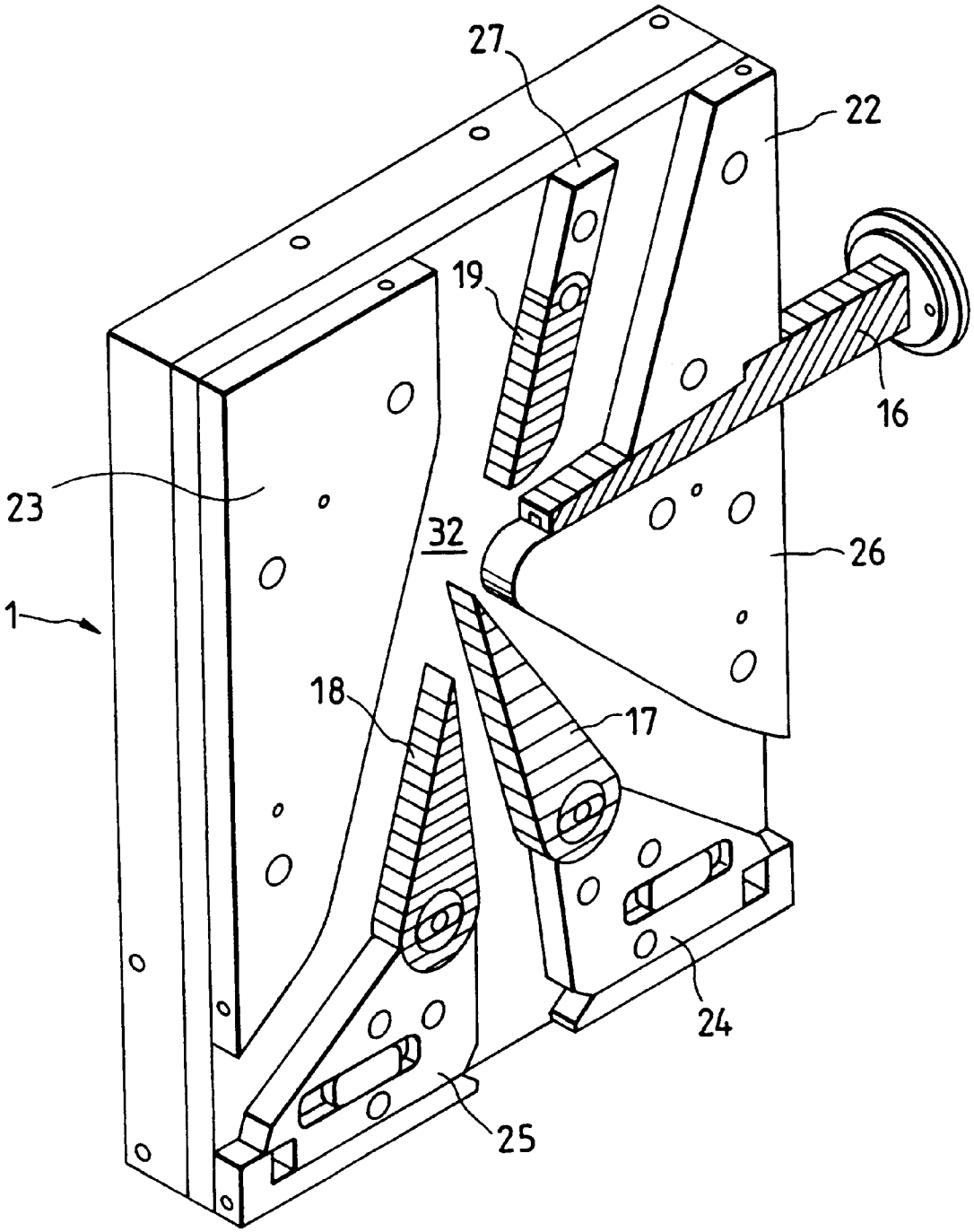
FIG. 2 is a cross-sectional perspective view of the gas current classifier of the present invention.
Figure 3:
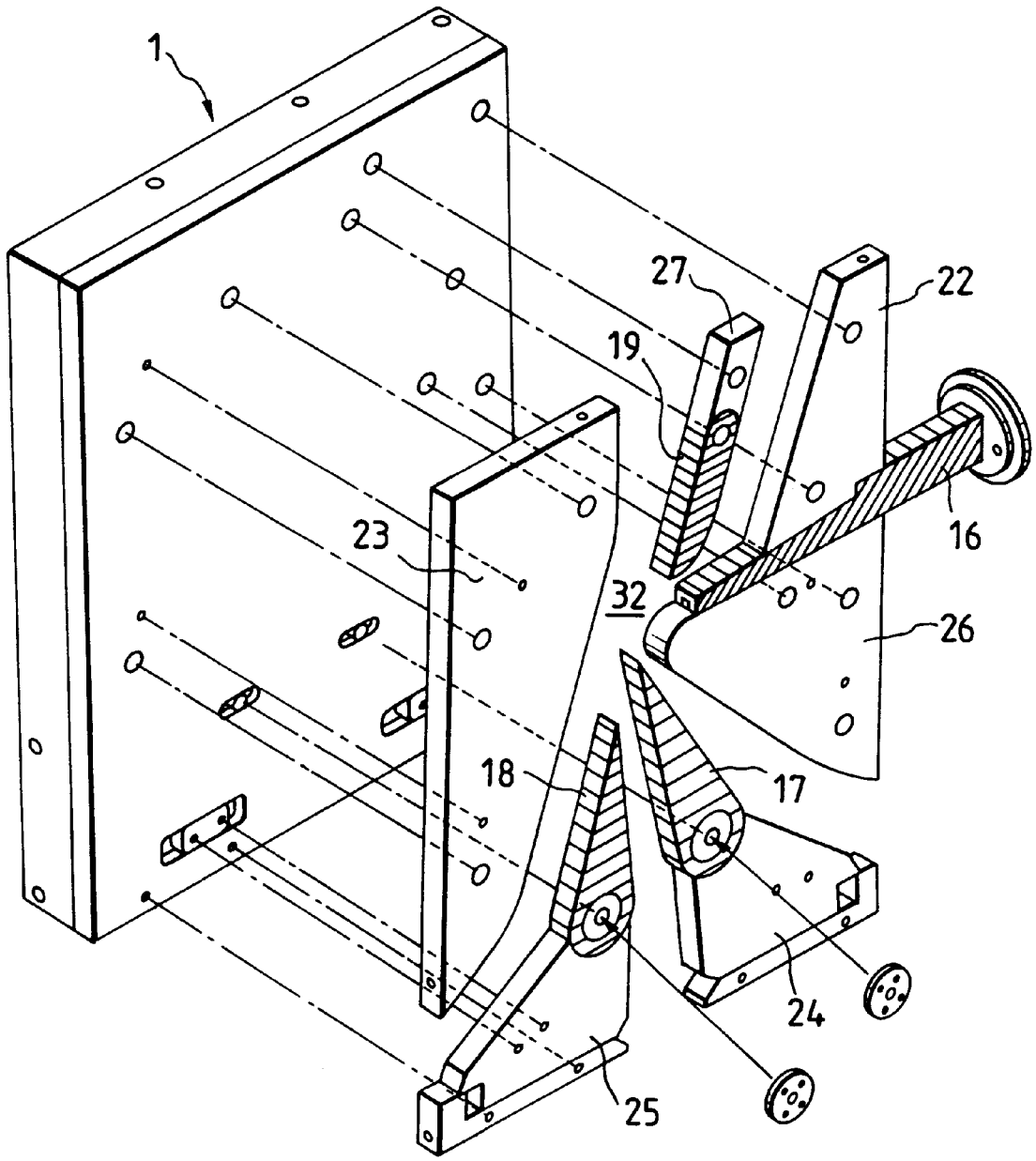
FIG. 3 is an exploded cross-sectional perspective view of the gas current classifier of the present invention.

An embodiment of the gas current classifier of the present invention can be exemplified by an apparatus of the type as shown in FIG. 1 (a sectional view) and FIGS. 2 and 3 (sectional perspective views) as a specific example.

In FIGS. 1, 2 and 3, side walls 22 and 23 form part of a classifying chamber, and a classifying wedge block 24 has a first classifying wedge 17 and another classifying wedge block 25 has a second classifying wedge 18. The classifying wedges 17 and 18 stand swing-movable around a first shaft 17*a* and a second shaft 18*a*, respectively, and thus the tip position of each classifying wedge can be changed by the swinging of the classifying wedge. The respective classifying wedge blocks 24 and 25 are so set up that their locations can be slid to the right and left. As they are slid, the corresponding knife edge-shaped classifying wedges 17 and 18 are also slid in the same direction or right and left in substantially the same direction. These classifying wedges 17 and 18 divide the classification zone of the classifying chamber 32 into three sections, i.e., a first classification zone for separating a fine powder group having particle diameters not larger than a given particle diameter, formed between a Coanda block and the first classifying wedge, a second classification zone for separating a median powder group having given particle diameters, formed between the first classifying wedge and the second classifying wedge, and a third classification zone for separating a coarse powder group having particle diameters not smaller than a given particle diameter.

At the lower part of the side wall 22, a material feed nozzle 16 having an orifice in the classifying chamber 32 is provided, and a Coanda block 26 is disposed along an extension of the lower tangential line of the material feed nozzle so as to form a long elliptic arc that curves downward. The classifying chamber 32 has an upper block 27 provided with a knife edge-shaped air-intake wedge 19 extending downward, and further provided above the classifying chamber 32 with air-intake pipes 14 and 15 opening into the classifying chamber 32. The air-intake pipes 14 and 15 are respectively provided with a first gas feed control means 20 and a second gas feed control means 21, respectively, comprising, e.g. a damper, and also provided with static pressure gauges 28 and 29.

The locations of the classifying wedges 17 and 18 and the air-intake wedge 19 are adjusted according to the kind of the powder, the feed material to be classified, and also to the desired particle size.

At the bottom of the classifying chamber 32, discharge outlets 11, 12 and 13 opening to the classifying chamber are provided correspondingly to the respective classification zones. The discharge outlets 11, 12 and 13 are connected with communicating means such as pipes, and may be respectively provided with shutter means such as valve means.

The material feed nozzle 16 comprises a flat rectangular pipe section and a tapered rectangular pipe section, and the ratio of the inner diameter of the flat rectangular pipe section to the inner diameter of the narrowest part of the tapered rectangular pipe section may be set to from 20:1 to 1:1, and preferably from 10:1 to 2:1, to obtain a good feed velocity.

The material feed nozzle 16 is, at its rear end, provided with a feed opening from which the powder is fed to the nozzle and an injection air feed pipe 31 through which the air for transporting the powder is fed.

The classification in the multi-division classifying zone having the above construction is operated, for example, in the following way. The inside of the classifying chamber is evacuated through at least one of the discharge outlets 11, 12 and 13. The powder is jetted at a high velocity into the classifying chamber 32 through the material feed nozzle 16 opening into the classifying chamber 32, at a flow velocity of from 50 m/sec to 300 m/sec utilizing the high-pressure air stream coming from the injection air feed pipe 31 and the air stream flowing inside the material feed nozzle 16 as a result of the evacuation.

The particles in the powder fed into the classifying chamber is moved to draw curves 30*a*, 30*b* and 30*c* by the action attributable to the Coanda effect of the Coanda block 26 and the action of gases such as air concurrently flowed in, and classified according to the particle size and inertia force of the individual particles in such a way that larger particles (coarse particles) are classified to the first division at the outside of air streams, i.e., the outer side of the classifying wedge 18, given median particles are classified to the second division defined between the classifying wedges 18 and 17, and smaller particles are classified to the third division at the inner side of the classifying wedge 17. The larger particles thus classified, the median particles classified and the smaller particles classified are discharged from the discharge outlets 11, 12 and 13, respectively.

In the classification of powder according to the present embodiment, the classification point chiefly depends on the tip position of the classifying wedges 17 and 18 with respect to the left end of the Coanda block 26 at which end the powder is jetted out into the classifying chamber 32. The classification point is also influenced by the flow rate of classification air streams or the velocity of the powder jetted out of the material feed nozzle 16.

In the gas current classifier of the present invention, upon the introduction of the powder into the classifying chamber 32, the powder is dispersed according to the size of the particles in the powder to form particle streams. Thus, the classifying wedges are shifted in the direction along the streamlines and then the tip positions of the classifying wedges are set stationary, so that they can be set at given classification points. When these classifying wedges 17 and 18 are shifted, they are shifted concurrently with the shift of the classifying wedge blocks 24 and 25, whereby the classifying wedges can be shifted along the directions of streams of the particles flying along the Coanda block 26.

In the gas current classifier of the present invention, the first and second classifying wedges are supported on a first shaft and a second shaft, respectively, so as to be swing-movable, and the distance between the first shaft which supports the first classifying wedge and the Coanda block is changeable, the distance between the first shaft and the second shaft which supports the second classifying wedge is changeable, and the distance between the second shaft and a classifier side wall opposing thereto.

Figure 4:
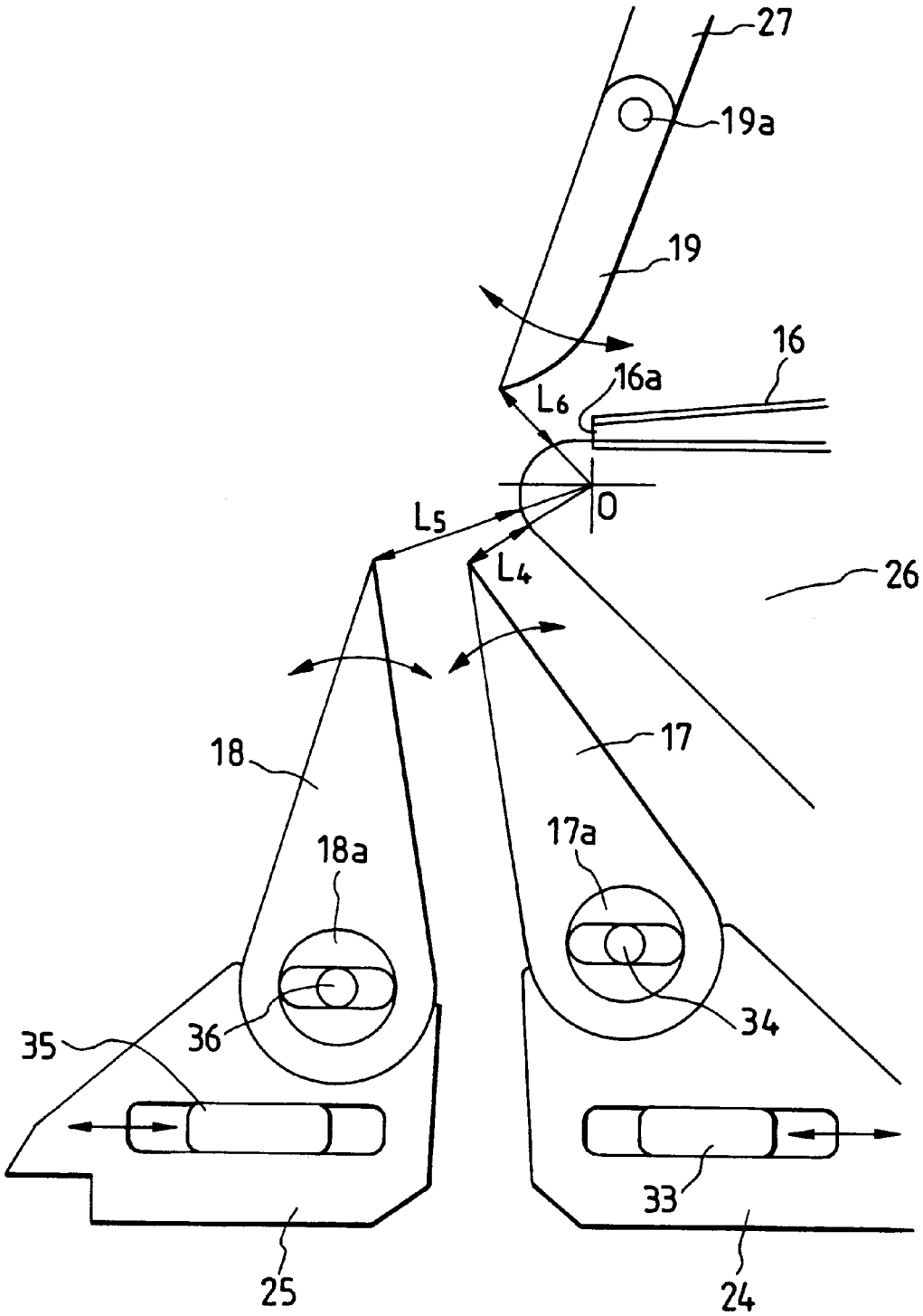
FIG. 4 illustrates the main part in FIG. 1.

Stated specifically, as shown in FIG. 4, a position O, for example, in the Coanda block 26, corresponding to the lower part of the tip of the orifice 16*a* of the material feed nozzle 16, is assumed as the center, where a distance $L_4$ between the tip of the classifying wedge 17 and the wall surface of the Coanda block 26 can be adjusted by shifting right and left the classifying wedge block 24 along a locating member 33 so that the classifying wedge 17 is shifted right and left along a locating member 34, and also by swingingly moving the tip of the classifying wedge 17 around the shaft 17*a*. Similarly, a distance $L_5$ between the tip of the classifying wedge 18 and the wall surface of the Coanda block 26 can be adjusted by shifting right and left the classifying wedge block 25 along a locating member 35 so that the classifying wedge 18 is shifted right and left along a locating member 36, and also by swingingly moving the tip of the classifying wedge 18 around the shaft 18*a*. As the set-up locations of the classifying wedge block 24 and/or the classifying wedge block 25 are changed, the form of the classification zone in the classifying chamber changes. Thus, the classification points can be adjusted with ease and in wide ranges.

Figure 6:
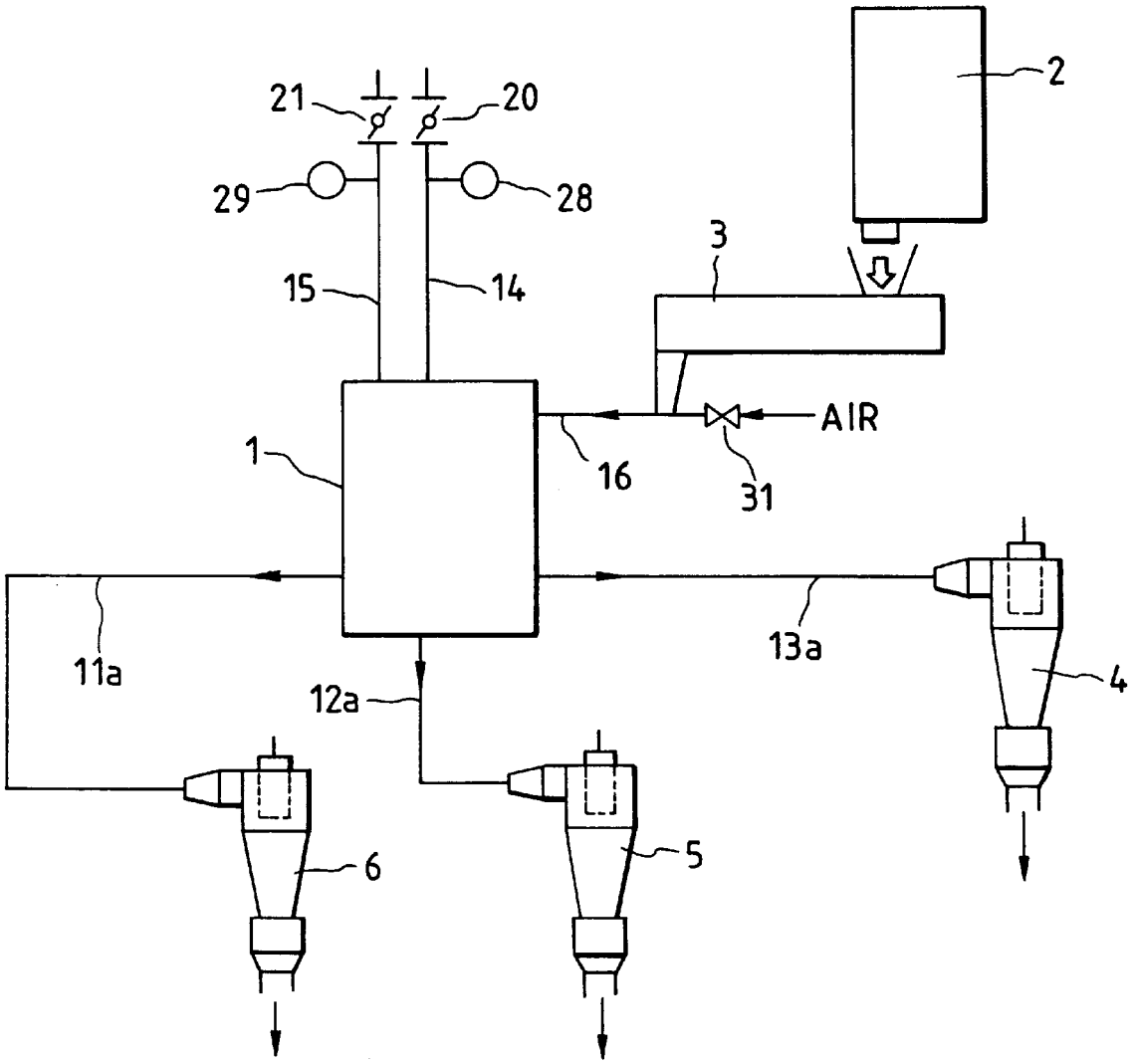
FIG. 6 illustrates an example of a classification process carried out using the gas current classifier of the present invention.

Hence, the disturbance of streams caused by the tips of the classifying wedges can be prevented, and the flying velocity of particles can be increased to more improve the dispersion of powder in the classification zone, by adjusting the flow rates of suction streams produced by the evacuation through discharge pipes 11*a*, 12*a* and 13*a* (FIG. 6). Thus, not only a good classification precision can be achieved even in a high powder concentration and the yield of products can be prevented from lowering, but also a better classification precision and an improvement in the yield of products can be achieved in the same powder concentration.

A distance $L_6$ between the tip of the air-intake wedge 19 and the wall surface of the Coanda block 26 can be adjusted by swingingly moving the tip of the air-intake wedge 19 around a shaft 19*a*. Thus, the classification points can be further adjusted by controlling the flow rate and flow velocity of the air or gases flowing from the air-intake pipes 14 and 15.

When the colored resin powder is classified in order to produce toners, $L_0$, $L_1$, $L_2$, $L_3$, $L_4$, $L_5$ and $L_6$ shown in FIG. 5 may preferably be adjusted as shown below.

Figure 5:
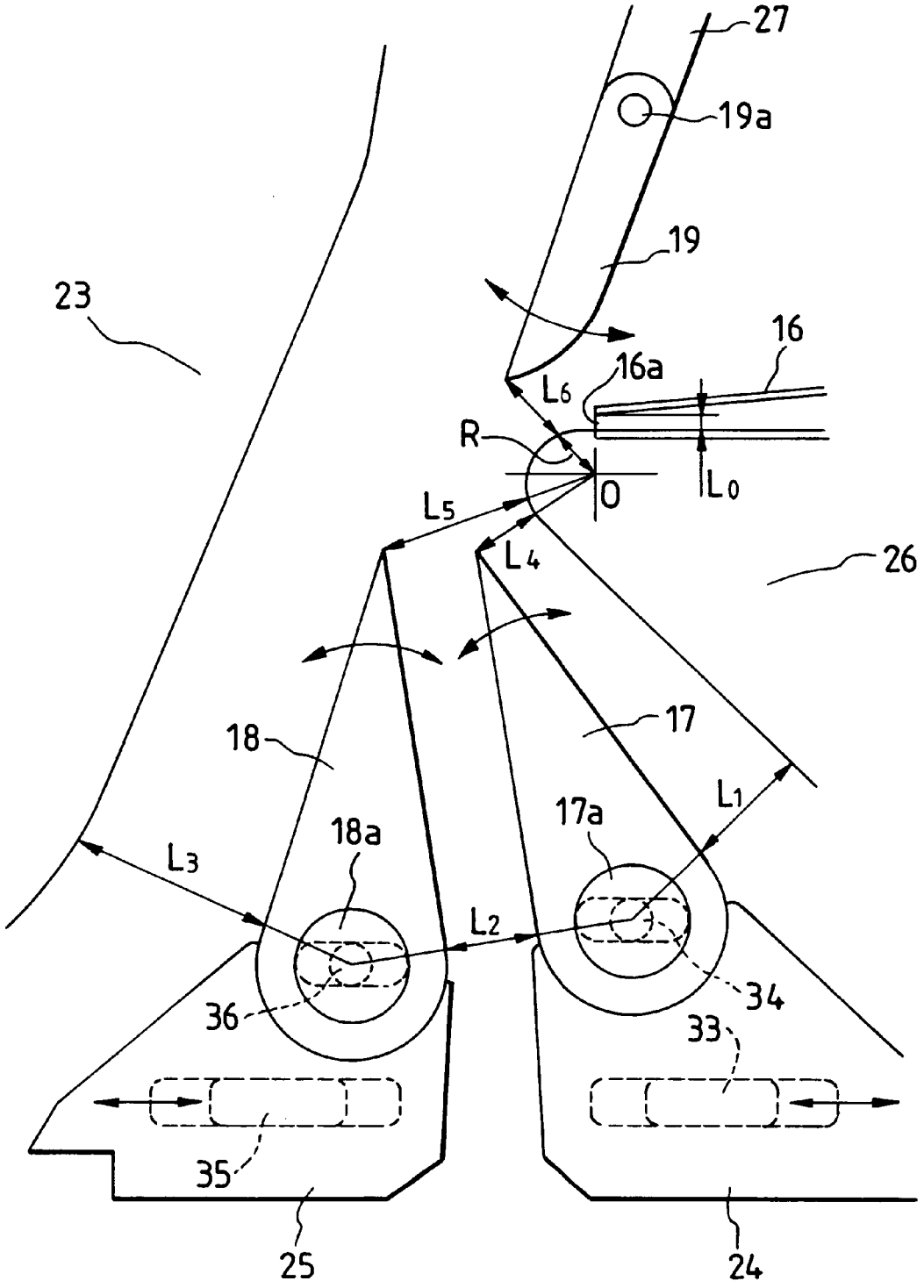
FIG. 5 illustrates the main part in FIG. 1.

In FIG. 5, a position O, for example, in the Coanda block 26, corresponding to the lower part of the tip of the orifice 16*a* of the material feed nozzle 16, is assumed as the center, where a distance $L_4$ between the tip of the first classifying wedge 17 and the wall surface of the Coanda block 26 and a distance $L_1$ between the side of the first classifying wedge 17 and the wall surface of the Coanda block 26 can be adjusted by shifting right and left the first classifying wedge block 24 along the locating member 33 so that the first classifying wedge 17 is shifted right and left along the locating member 34, and also by swingingly moving the tip of the first classifying wedge 17 around the first shaft 17*a*.

Similarly, a distance $L_5$ between the tip of the second classifying wedge 18 and the wall surface of the Coanda block 26 and a distance $L_2$ between the side of the first classifying wedge 17 and the side of the second classifying wedge 18 or a distance $L_3$ between the side of the second classifying wedge 18 and the surface of the side wall 23 can be adjusted by shifting right and left the second classifying wedge block 25 along the locating member 35 so that the second classifying wedge 18 is shifted right and left along the locating member 36, and also by swingingly moving the tip of the second classifying wedge 18 around the second shaft 18*a*. That is, as the set-up locations of the first classifying wedge block 24 and/or the second classifying wedge block 25 are changed, the form of the classification zone in the classifying chamber changes. Thus, the classification points can be adjusted with ease and in wide ranges.

Hence, the disturbance of streams caused by the tips of the classifying wedges can be prevented, and the flying velocity of particles can be increased to more improve the dispersion of finely pulverized powder in the classifying chamber and classification zone, by adjusting the flow rates of suction streams produced by the evacuation through discharge pipes 11*a*, 12*a* and 13*a*. Thus, not only a good classification precision can be achieved even in a high powder concentration and the yield of products can be prevented from lowering, but also a better classification precision and an improvement in the yield of products can be achieved in the same powder concentration.

A distance $L_6$ between the tip of the air-intake wedge 19 and the wall surface of the Coanda block 26 can be adjusted by swingingly moving the tip of the air-intake wedge 19 around the shaft 19*a*. Thus, the classification points can be further adjusted by controlling the flow rate and flow velocity of the air or gases flowing from the air-intake pipes 14 and 15.

The set-up distances described above are appropriately determined according to the properties of pulverized materials. In the case when a finely pulverized product has a true density of from 0.3 to 1.4 g/cm$^3$, the location must satisfy the condition of:

$$L_0<L_1+L_2<nL_3$$

(n is a real number of 1 or more)
and in the case of more than 1.4 g/cm$^3$;

$$L_0<L_3<L_1+L_2$$

When this location is satisfied, products (median powder) having a sharp particle size distribution can be obtained in a good efficiency.

Stated specifically, in order to classify a powder containing 50% by number or more of particles with a particle size of 20 $\mu$m or smaller, in a good efficiency over a long period of time, it is preferred that $L_0$ is 2 to 10 mm, $L_1$ is 10 to 150 mm, $L_2$ is 10 to 150 mm, $L_3$ is 10 to 150 mm, $L_4$ is 5 to 70 mm, $L_5$ is 15 to 160 mm, $L_6$ is 10 to 100 mm and n is 1 to 3.

The gas current classifier of the present invention is usually used as a component unit of a unit system in which correlated equipments are connected through communicating means such as pipes. A preferred example of such a unit system is shown in FIG. 6. In the unit system as illustrated in FIG. 6, a three-division classifier 1 (the classifier as illustrated in FIGS. 1 and 2), a continuous feeder 2, a vibrating feeder 3, a collecting cyclone 4, a collecting cyclone 5 and a collecting cyclone 6 are all connected through communicating means.

In this unit system, the powder is fed into the continuous feeder 2 through a suitable means, and then introduced into the three-division classifier 1 from the vibrating feeder 3 through the material feed nozzle 16. When introduced, the powder is fed into the three-division classifier 1 at a flow velocity of 50 to 300 m/sec. The classifying chamber of the three-division classifier 1 is constructed usually with a size of [10 to 50 cm]×[10 to 50 cm], so that the powder can be instantaneously classified in 0.1 to 0.01 second or less, into three or more groups of particles. Then, the powder is classified by the three-division classifier 1 into the group of larger particles (coarse particles), group of given median particles and group of smaller particles. Thereafter, the group of larger particles is passed through a discharge guide pipe 11*a*, and sent to and collected in the collecting cyclone 6. The group of median particles is discharged outside the classifier through the discharge pipe 12*a*, and collected in the collecting cyclone 5. The group of smaller particles is discharged outside the classifier through the discharge pipe 13*a* and collected in the collecting cyclone 4. The collecting cyclones 4, 5 and 6 may also function as suction evacuation means for suction feeding the powder to the classifying chamber through the material feed nozzle 16.

The gas current classifier of the present invention is effective especially when toners or colored resin powders for toners used in image formation carried out by electrophotography are classified. In particular, it is effective when toner compositions comprising a binder resin having a low melting point, a low softening point and a low glass transition point are classified. If the toner compositions making use of such a resin are fed to conventional classifiers, particles tend to melt-adhere to the tips of classifying wedges, and once they have melt-adhered, classification points may deviate from suitable values. If, in such a state, flow rates are adjusted by suction evacuation, it is difficult to obtain the required particle size distribution of the powder, resulting in a great decrease in classification efficiency. Moreover, the matter produced by melt adhesion may mix into the classified powder to make it difficult to obtain products with a good quality.

In the classifier of the present invention, when the classifying wedges 17 and 18 are shifted, they are shifted concurrently with the shift of the classifying wedge blocks 24 and 25 so that the classifying wedges are shifted along the directions of streams of the particles flying along the Coanda block 26, whereupon the flow rates of suction streams are adjusted through the discharge pipes 11*a*, 12*a* and 13*a* serving as suction evacuation means. Thus, the flying velocity of particles can be increased to more improve the dispersion of powder in the classification zone, and hence the classification yield can be improved and also the particles can be prevented from adhering to the tips of classifying wedges to effectively enable high-precision classification.

The classifier of the present invention can be more remarkably effective as the powder has smaller particle diameters, and can be more preferably applied especially when powders with a weight average particle diameter of 10 $\mu$m or smaller are classified, and still more preferably when powders with a weight average particle diameter of 8 $\mu$m or smaller are classified.

The toner particles constituting toners may preferably contain at least a non-magnetic colorant and/or a magnetic material and a binder resin, and the binder resin may have a glass transition point of from 45° C. to 80° C., and more preferably from 50° C. to 75° C., in view of heat fixing performance and blocking resistance. A preferred binder resin may include styrene-acrylic copolymers, styrene-methacrylic copolymers, polyester resins and a mixture of any of these.

In the case when the colorant is a non-magnetic colorant such as carbon black or phthalocyanine, the colorant may preferably be mixed in an amount of from 0.5 to 20 parts by weight, and preferably from 1 to 15 parts by weight, based on 100 parts by weight of the binder resin.

In the case when the colorant is a magnetic material such as magnetite or magnetic ferrite, the magnetic material may preferably be mixed in an amount of from 20 to 200 parts by weight, and preferably from 30 to 150 parts by weight, based on 100 parts by weight of the binder resin.

The colored resin particles that form toner particles may be prepared by melt-kneading and pulverization, or may be prepared by suspension polymerization or emulsion polymerization.

In the classifier of the present invention, the direction of each classifying wedge and the wedge tip position may be changed by means of a stepping motor as a shifting means and the wedge tip position may be detected by means of a potentiometer as a detecting means. A control device for controlling these may control the tip positions of classifying wedges and also the control of flow rates may be automated. This is more preferable since the desired classification points can be obtained in a short time and more accurately.

As described above, the gas current classifier of the present invention makes it possible to well prevent particles from melt-adhereing to the tips of classifying wedges, to well prevent classification streams from being disturbed at the tips of classifying wedges, to obtain accurate classification points in accordance with the gravity of various powders and the conditions of classification streams, and to improve classification yield without causing deviations of classification points also when the apparatus is continuously operated.

Examples in which products (toners) are actually obtained by classifying colored resin powders for toner production are shown below.

EXAMPLE 1

Styrene/butyl acrylate/divinylbenzene copolymer (monomer polymerization weight ratio: 80.0/19.0/1.0; weight average molecular weight: 350,000; glass transition point: about 55° C.) 100 parts Magnetic iron oxide (average particle diameter: 0.18 $\mu$m 100 parts Nigrosine 2 parts Low-molecular weight ethylene/propylene copolymer 4 parts (by weight)

The above materials were thoroughly mixed using a Henschel mixer (FM-75 Type, manufactured by Mitsui Miike Engineering Corporation), and thereafter kneaded using a twin-screw kneader (PM-30 Type, manufactured by Ikegai Corp.) set to a temperature of 150° C. The kneaded product obtained was cooled, and then crushed by means of a hammer mill to a size of 1 mm or less to obtain a crushed product. The crushed product was pulverized using an impact type air pulverizer to obtain a colored resin powder having a weight average particle diameter of 7.0 $\mu$m. This colored resin powder had a true density of 1.73 g/cm$^3$.

In the classification system as shown in FIG. 6, the colored resin powder thus obtained was introduced into the multi-division classifier shown in FIGS. 1 and 5, through the feeder 2 and also through the vibrating feeder 3 and the material feed pipe 16, in order to classify the powder into the three, coarse powder, median powder and fine powder groups at a rate of 35.0 kg/hr by utilizing the Coanda effect.

The powder was introduced by utilizing the suction force derived from the evacuation of the inside of the system by suction evacuation through the collecting cyclons 4, 5 and 6 communicating with the discharge outlets 11, 12 and 13, respectively, and utilizing the air compression fed from the injection nozzle 31.

In order to change the form of the classification zone, the respective location distances as shown in FIG. 5 were set as shown below, to carry out classification.

$L_0$: 6 mm (the height-direction diameter of the material feed nozzle discharge orifice 16*a*)

$L_1$: 32 mm (the distance between the sides facing each other, of the classifying wedge 17 and the Coanda block 26)

$L_2$: 33 mm (the distance between the sides facing each other, of the classifying wedge 17 and the classifying wedge 18)

$L_3$: 39 mm (the distance between the sides facing each other, of the classifying wedge 18 and the surface of the side wall 23)

$L_4$: 14 mm (the distance between the tip of the classifying wedge 17 and the side of the Coanda block 26)

$L_5$: 33 mm (the distance between the tip of the classifying wedge 18 and the side of the Coanda block 26)

$L_6$: 25 mm (the distance between the tip of the air-intake wedge 19 and the side of the Coanda block 26)

R: 14 mm (the radius of the arc of the Coanda block 26)

The colored resin powder thus introduced was instantaneously classified in 0.1 second or less. The median powder group classified had a sharp particle size distribution with a weight average particle diameter of 6.85 μm (containing 24% by number of particles with particle diameters of 4.0 μm or smaller and containing 1.0% by volume of particles with particle diameters of 10.08 μm or larger), and the median powder group was obtainable in a classification yield (the percentage of the median powder finally obtained, to the total weight of the pulverized material fed) of 89%. The median powder group obtained had a good performance for use in toner. The coarse powder group classified here was again circulated to the step of pulverization.

The true density of the colored resin powder was measured using Micromeritics Accupyc 1330 (manufactured by Shimadzu Corporation) as a measuring device, and 5 g of the colored resin powder was weighed to determine its true density.

The particle size distribution of the toner can be measured by various methods. In the present invention, it was measured using the following measuring device.

A Coulter counter TA-II or Coulter Multisizer II (manufactured by Coulter Electronics, Inc.) was used as a measuring device. As an electrolytic solution, an aqueous about 1% NaCl solution was prepared using first-grade sodium chloride. For example, ISOTON R-II (trade name; available from Coulter Scientific Japan Co.) can be used. Measurement was carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample had been suspended was subjected to dispersion for about 1 minute to about 3 minutes in an ultrasonic dispersion machine. The volume and number of toner particles were measured by means of the above measuring device, using an aperture of 100 μm as its aperture to calculate the volume distribution and number distribution of the toner particles. Then, weight-based weight average particle diameter of the toner, obtained from the volume distribution of the toner particles was determined.

EXAMPLES 2 to 4

The pulverized materials (colored resin powders) shown in Table 1, obtained by pulverizing the same crushed product as used in Example 1 for producing the toner, by means of an impact type air pulverizer were classified using the same unit system except that the location distances were set as shown in Table 1.

As shown in Tables 2 and 3, median powder groups all having a sharp particle size distribution were obtainable in a good efficiency, and the median powder groups thus obtained had good performances for toners.

TABLE 1

| Example: | Pulverized material (1) (μm) | (2) (g/cm³) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 1 | 7.0 | 1.73 | 35.0 | 6 | 32 | 33 | 39 | 14 | 33 | 25 | 14 |
| 2 | 6.3 | 1.73 | 31.0 | 6 | 33 | 32 | 39 | 16 | 33 | 25 | 14 |
| 3 | 5.5 | 1.73 | 25.0 | 6 | 30 | 34 | 39 | 13 | 32 | 25 | 14 |
| 4 | 5.5 | 1.73 | 25.0 | 6 | 34 | 30 | 39 | 16 | 33 | 25 | 14 |

(1): Weight average particle diameter
(2): True density
(3): Rate of feed into classifier

TABLE 2

| Example: | Median powder group: Weight average particle diameter (μm) | Particle size distribution: Particles with particle diameters of: 4.00 μm or smaller (% by number) | 10.08 μm or larger (% by volume) | Classification yield (%) |
|---|---|---|---|---|
| 1 | 6.85 | 24 | 1.0 | 89 |
| 2 | 5.9 | 30 | 0.2 | 89 |

TABLE 3

| Example: | Median powder group: Weight average particle diameter (μm) | Particle size distribution: Particles with particle diameters of: 3.17 μm or smaller (% by number) | 8.00 μm or larger (% by volume) | Classification yield (%) |
|---|---|---|---|---|
| 3 | 5.2 | 29 | 2.6 | 84 |
| 4 | 5.4 | 18 | 1.9 | 79 |

EXAMPLES 5 & 6

Unsaturated polyester resin (glass transition point: about 55° C.) 100 parts

Copper phthalocyanine pigment (C.I. Pigment Blue 15) 4.5 parts Charge control agent 4.0 parts (by weight)

The above materials were thoroughly mixed using the same Henschel mixer as used in Example 1, and thereafter kneaded using the same twin-screw kneader as used in Example 1 set to a temperature of 100° C. The kneaded product obtained was cooled, and then crushed by means of a hammer mill to a size of 1 mm or less to obtain a crushed product. The crushed product was pulverized using an impact type air pulverizer to obtain a colored resin powder having a weight average particle diameter of 6.6 μm (Example 5). This colored resin powder had a true density of 1.08 g/cm³.

The colored resin powders obtained were classified using the same unit system as in Example 1 except that the classification was carried out under conditions as shown in Table 4.

The above crushed product was pulverized using an impact type air pulverizer to obtain a colored resin powder having a weight average particle diameter of 5.5 μm (Example 6), which was then classified under conditions as shown in Table 4.

As shown in Tables 5 and 6, median powder groups all having a sharp particle size distribution were obtainable in a good efficiency, and the median powder groups thus obtained had good performances for toners.

TABLE 4

| Example: | Pulverized material (1) (μm) | (2) (g/cm³) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 5 | 6.6 | 1.08 | 31.0 | 6 | 28 | 17 | 35 | 16 | 30 | 25 | 8 |
| 6 | 5.5 | 1.08 | 24.0 | 9 | 26 | 17 | 39 | 16 | 29 | 25 | 8 |

(1): Weight average particle diameter
(2): True density
(3): Rate of feed into classifier

TABLE 5

| Example: | Median powder group: Weight average particle diameter (μm) | Particle size distribution Particles with particle diameters of: 4.00 μm or smaller (% by number) | 10.08 μm or larger (% by volume) | Classification yield (%) |
|---|---|---|---|---|
| 5 | 5.85 | 23 | 1.0 | 86 |

TABLE 6

| Example: | Median powder group: Weight average particle diameter (μm) | Particle size distribution Particles with particle diameters of: 3.17 μm or smaller (% by number) | 8.00 μm or larger (% by volume) | Classification yield (%) |
|---|---|---|---|---|
| 6 | 5.7 | 10 | 1.9 | 75 |

Comparative Examples 1 to 3

Using the same toner materials as used in Example 1, the crushed product was pulverized using the impact type air pulverizer to obtain a pulverized material having a weight average particle diameter of 6.9 μm (Comparative Example 1) and a pulverized material having a weight average particle diameter of 5.5 μm (Comparative Example 2).

The toner materials were replaced with those as used in Example 5 to obtain a pulverized material having a weight average particle diameter of 6.5 μm (Comparative Example 3).

Figure 7:
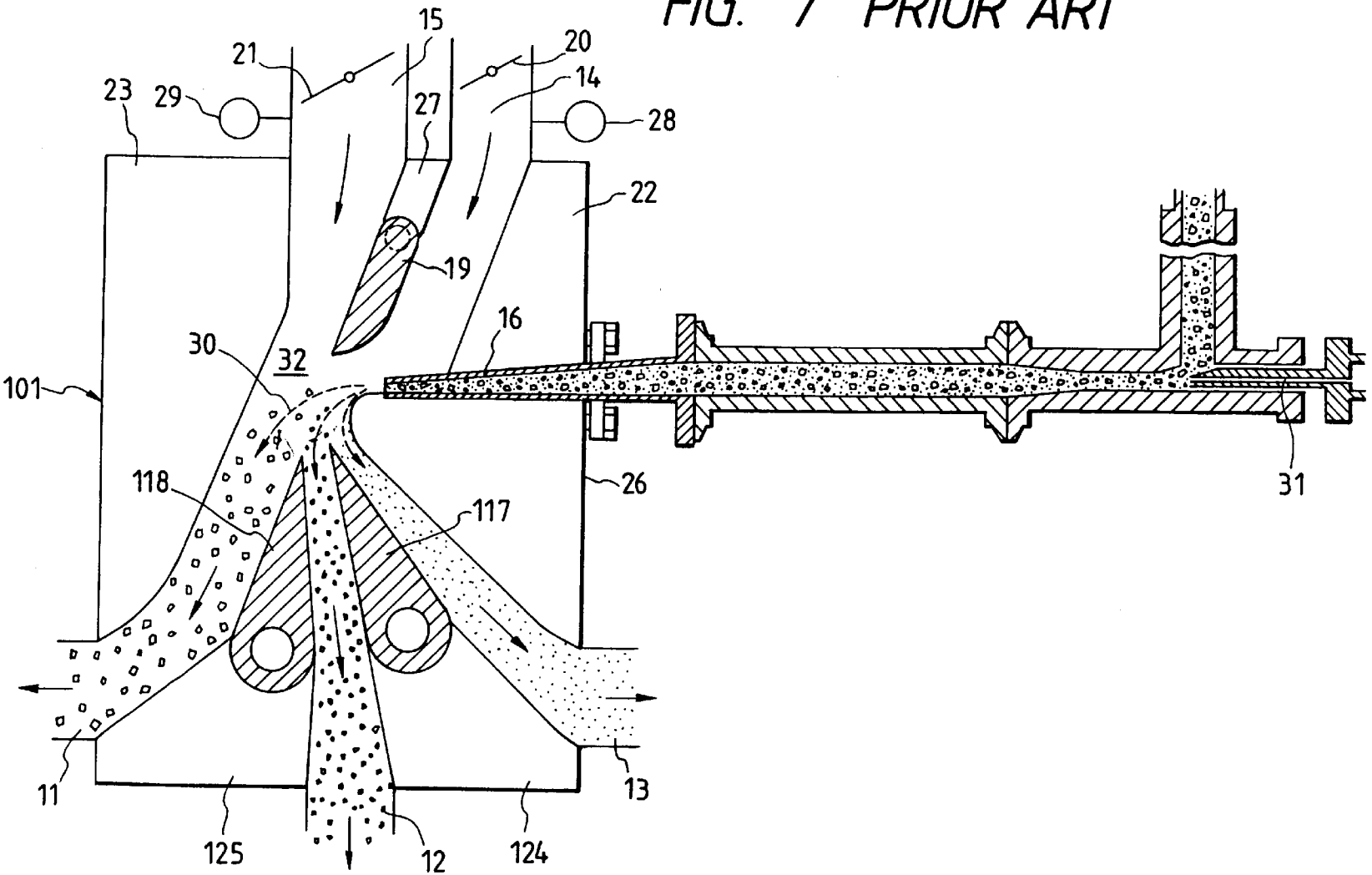
FIG. 7 PRIOR ART
FIG. 7 is a schematic cross section of a conventional gas current classifier.
Figure 8:
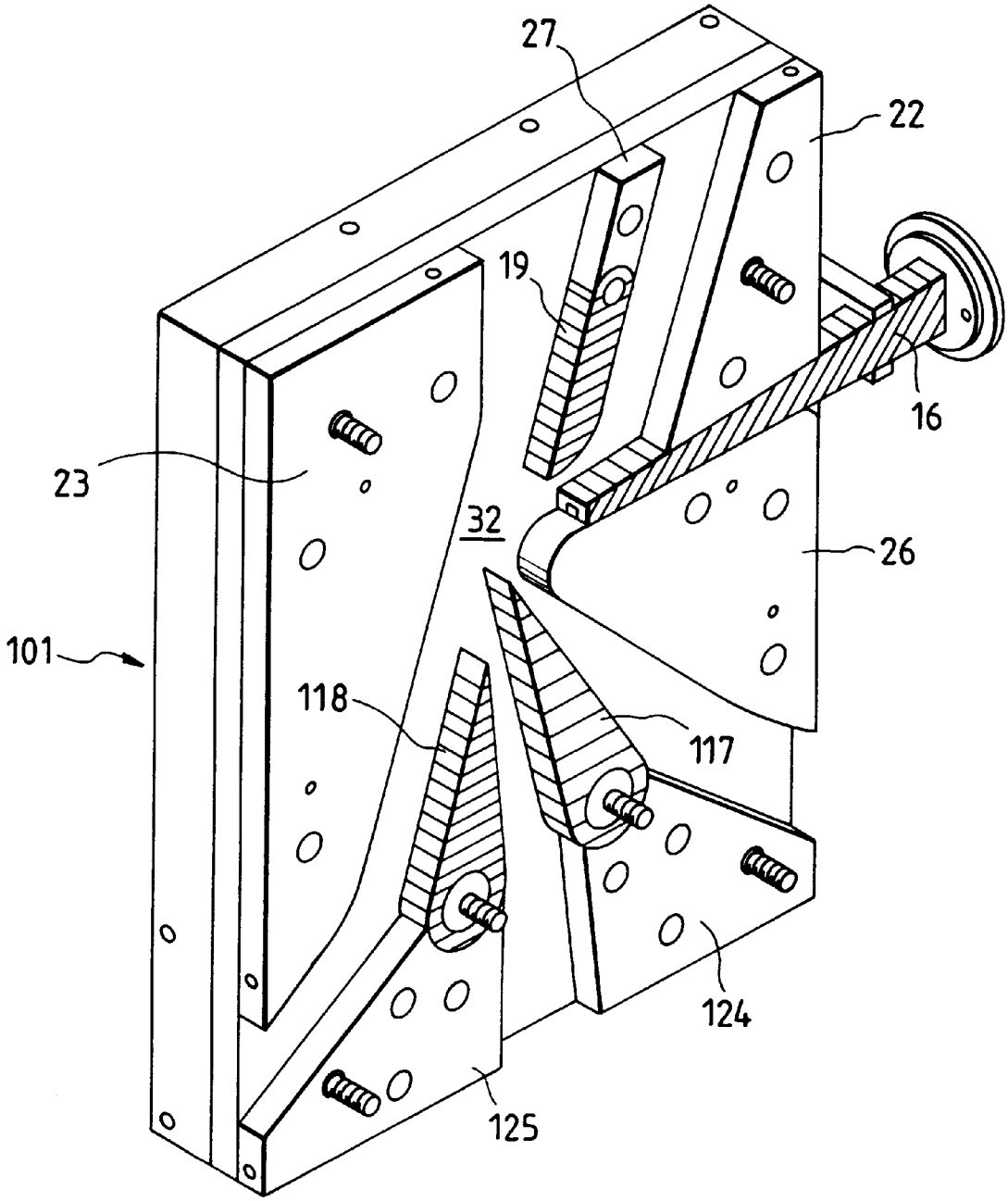
FIG. 8 PRIOR ART
FIG. 8 is a cross-sectional perspective view of the conventional gas current classifier.
Figure 9:
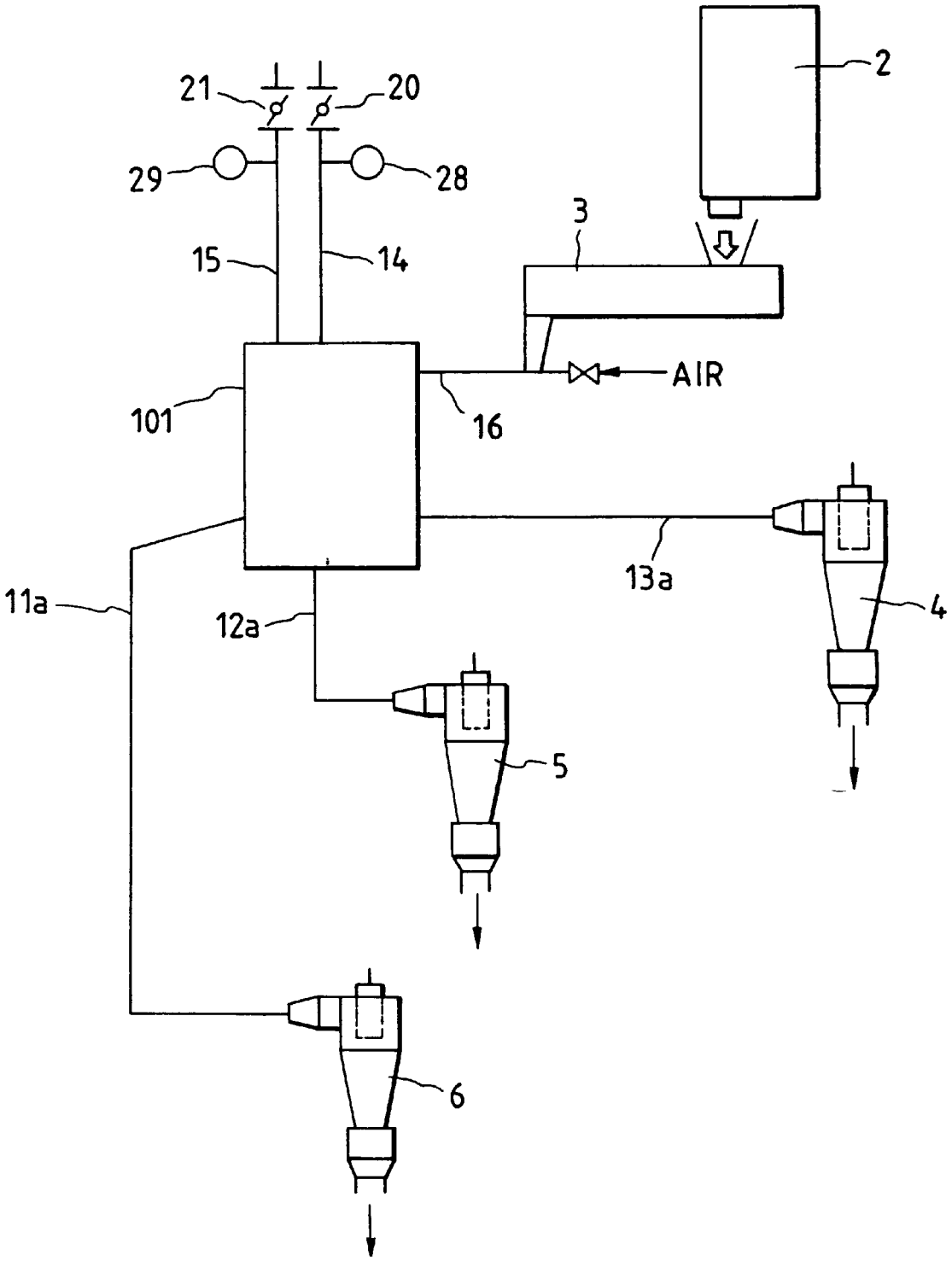
FIG. 9 illustrates an example of a conventional classification process.

The pulverized materials obtained were each classified according the flow chart as shown in FIG. 9, using the multi-division classifier as shown in FIGS. 7 and 8.

The classification of each pulverized material was carried out under conditions as shown in Table 7, and the particle size distribution and so forth of the median powder groups obtained by the classification were as shown in Tables 8 to 10.

TABLE 7

| Comparative Example: | Pulverized material (1) (μm) | (2) (g/cm³) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 1 | 6.9 | 1.73 | 30.0 | 6 | 30 | 25 | 55 | 17 | 29 | 25 | 14 |
| 2 | 5.5 | 1.73 | 25.0 | 6 | 30 | 25 | 55 | 14 | 29 | 25 | 14 |
| 3 | 6.5 | 1.08 | 31.0 | 6 | 30 | 25 | 55 | 14 | 25 | 25 | 14 |

(1): Weight average particle diameter
(2): True density
(3): Rate of feed into classifier

TABLE 8

| Comparative Example: | Median powder group: Weight average particle diameter (μm) | Particle size distribution Particles with particle diameters of: 4.00 μm or smaller (% by number) | 10.08 μm or larger (% by volume) | Classification yield (%) |
|---|---|---|---|---|
| 1 | 6.9 | 28 | 2.0 | 75 |

TABLE 9

| Comparative Example: | Median powder group: Weight average particle diameter (μm) | Particle size distribution Particles with particle diameters of: 3.17 μm or smaller (% by number) | 8.00 μm or larger (% by volume) | Classification yield (%) |
|---|---|---|---|---|
| 2 | 5.1 | 41 | 2.0 | 65 |

TABLE 10

| Comparative Example: | Median powder group: Weight average particle diameter (μm) | Particle size distribution Particles with particle diameters of: 4.00 μm or smaller (% by number) | 10.08 μm or larger (% by volume) | Classification yield (%) |
|---|---|---|---|---|
| 3 | 5.9 | 35 | 2.8 | 75 |

As described above, the adjustment of $L_0$, $L_1$, $L_2$, $L_3$, $L_4$, $L_5$ and $L_6$ in the gas current classifier of the present invention makes it possible to well prevent particles from melt-adhereing to the tips of classifying wedges, to well prevent classification streams from being disturbed at the tips of classifying wedges, to obtain accurate classification points in accordance with the gravity of various powders and the conditions of classification streams, and to improve classification yield without causing deviations of classification points also when the apparatus is continuously operated. The present invention is effective especially when pulverized materials for toners, with a weight average particle diameter of 10 $\mu$m or smaller are classified.

What is claimed is:

1. A gas current classifier for classifying a powder into a fine powder group, a median powder group and a coarse powder group, comprising a material feed nozzle, a Coanda block, classifier side walls a plurality of classifying wedge blocks each having a classifying wedge, wherein said Coanda block and said classifier side walls define a classification zone in a classifying chamber characterized in that each said classifying wedge block is shiftable along a locating member; and each said classifying wedge is shiftable along a locating member, so that distances $L_1$, $L_2$ and $L_3$ are changeable, wherein $L_1$, represents a distance in millimeters between the sides facing each other, of a first classifying wedge for dividing the powder into the median powder group and the fine powder group and the Coanda block opposed thereto; $L_2$ represents a distance in millimeters between the sides facing each other, of the first classifying wedge and a second classifying wedge for dividing the powder into the coarse powder group and the median powder group; and $L_3$ represents a distance in millimeters between the sides facing each other, of the second classifying wedge and a side wall opposed thereto.

2. The gas current classifier according to claim 1, wherein said classifying wedge is comprised of a first classifying wedge and a second classifying wedge; and a classification zone for separating group powder group having particle diameters not larger than a predetermined particle diameter is formed between the Coanda block and the first classifying wedge, a classification zone for separating a median powder group having predetermined particle diameters is formed between the first classifying wedge and the second classifying wedge, and a classification zone for separating a coarse powder group having particle diameters not smaller than a predetermined particle diameter is formed between the second classifying wedge and a classifier side wall opposing thereto.

3. The gas current classifier according to claim 1, wherein said classifying wedge block has the classifying wedge in the manner that the tip of the classifying wedge is swing-movable.

4. The gas current classifier according to claim 1, wherein said Coanda block is provided in contact with said material feed nozzle, and a classifying chamber for classifying a powder jetted from the material feed nozzle, into a group of particles having predetermined particle diameters and a group or groups of particles having particle diameters other than the predetermined particle diameters is provided between the Coanda block and a classifier side wall opposing thereto.

5. The gas current classifier according to claim 1, wherein said classifying wedges are set up in the manner that their locations are each controllable by a locating member so that each classifying wedge is shiftable to the same direction or substantially the same direction as the direction in which each classifying wedge block is shifted.

6. The gas current classifier according to claim 2, wherein said first and second classifying wedges are supported on a first shaft and a second shaft, respectively, so as to be swing-movable; and the distance between the first shaft supporting the first classifying wedge and the Coanda block is changeable, the distance between the first shaft and the second shaft supporting the second classifying wedge is changeable, and the distance between the second shaft and the side wall is changeable.

* * * * *

UNITED STATES PATENT AND TRADEMARK OFFICE

CERTIFICATE OF CORRECTION

PATENT NO. : 5,931,306

DATED : August 3, 1999

INVENTOR(S) : SATOSHI MITSUMURA ET AL.

It is certified that error appears in the above-identified patent and that said Letters Patent is hereby corrected as shown below:

ON THE TITLE PAGE [62]

Related U.S. Application Data, "Jan. 23, 1995," should read --Jan. 23, 1997,--.

COLUMN 1

Line 35, "part." should read --parts.--; and
Line 36, "part" should read --parts--.

COLUMN 2

Line 8, "good resulting" should read --good precision, resulting--;
Line 10, "group" (1st occurrence) should read --groups--;
Line 13, "can not" should read --cannot--; and
Line 16, "takes" should read --take--.

COLUMN 4

Line 1, "$L_0>0$, $L_1>$, $L_2>0$, $L_3>0$; $L_0<L_1 + L_2<nL_3$" should read --$L_0>0$, $L_1>0$, $L_2>0$, $L_3>0$; $L_0<L_1 + L_2<nL_3$--; and
Line 34, "manner that" should read --manner such that--.

COLUMN 13

Line 62, "according" should read --according to--.

UNITED STATES PATENT AND TRADEMARK OFFICE

CERTIFICATE OF CORRECTION

PATENT NO. : 5,931,306

DATED : August 3, 1999

INVENTOR(S) : SATOSHI MITSUMURA ET AL.

It is certified that error appears in the above-identified patent and that said Letters Patent is hereby corrected as shown below:

COLUMN 15

Line 31, "group" (1st occurrence) should read --a fine--.

Signed and Sealed this

Ninth Day of May, 2000

*Attest:*

Q. TODD DICKINSON

*Attesting Officer*

*Director of Patents and Trademarks*